United States Patent [19]

Oberdorfer

[11] Patent Number: 4,589,329

[45] Date of Patent: May 20, 1986

[54] PISTON MACHINE HAVING AT LEAST TWO PISTONS

[76] Inventor: Guido Oberdorfer, Guido-Oberdorfer-Str. 2-8, Bellenberg, Fed. Rep. of Germany, 7919

[21] Appl. No.: 504,249

[22] Filed: Jun. 14, 1983

[30] Foreign Application Priority Data

Jun. 18, 1982 [CH] Switzerland ..... 3756/82
Jul. 15, 1982 [CH] Switzerland ..... 4294/82

[51] Int. Cl.[4] ..... F01B 1/06

[52] U.S. Cl. ..... 92/72; 417/273; 417/534

[58] Field of Search ..... 92/72; 417/273; 91/493, 91/494

[56] References Cited

U.S. PATENT DOCUMENTS 1,964,245 6/1934 Benedek et al. ..... 92/72
2,324,291 7/1943 Dodge ..... 417/273
2,679,808 6/1954 Thun ..... 417/273
2,801,596 8/1957 Sewell ..... 417/273
3,125,034 3/1964 Lucien et al. ..... 417/273
3,160,073 12/1964 Lucien et al. ..... 91/494
3,413,929 12/1968 Cook et al. ..... 417/273
3,924,968 12/1975 Gaines ..... 417/273

*Primary Examiner*—William L. Freeh
*Attorney, Agent, or Firm*—Berman, Aisenberg & Platt

[57] ABSTRACT

The piston machine contains three pistons (5) which are arranged in star form around the shaft end (9). The foot part (15) of the respective piston (5) is provided with a shoe (19) carrying a plate (20). This plate (20) lies on a sleeve (13) mounted on an eccentric (11). A return device (14), whose claws (17) lie on the upper face of the plate (20), is also mounted on the eccentric.

A piston machine of this kind runs steadily and can be produced inexpensively.

5 Claims, 18 Drawing Figures

PISTON MACHINE HAVING AT LEAST TWO PISTONS

Figure 1:
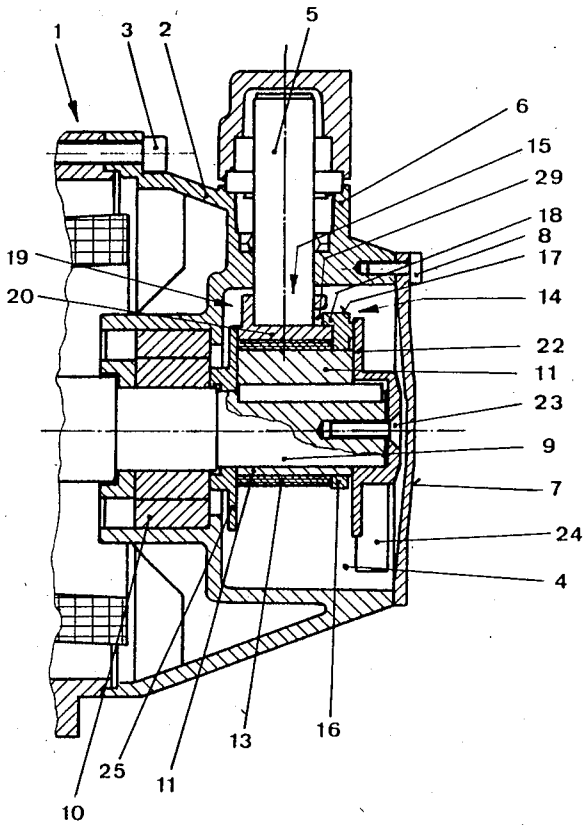

The present invention relates to a piston machine having at least two pistons and having an eccentric which is mounted on the machine shaft and can act on the foot part of the pistons.

In machines having at least three pistons distributed around a common shaft the arrangement of the pistons is said to be star-shaped. In such cases the connection between the pistons and the shaft is often made with the aid of connecting rods. The use of connecting rods constitutes a relatively expensive solution.

Particularly in the case of pumps having pistons and cylinders arranged in star form, a less expensive solution is applied. An eccentric producing the forwardly directed movement of the pistons is mounted on the shaft. The pistons are then returned with the aid of compression springs, which are accommodated in the delivery chambers of the respective cylinders. However, this solution entails quite a number of disadvantages. On each stroke the pressure of the return springs must be overcome, and this results in a loss of energy. Another disadvantage consists in that there is a fixed relationship between the speed of rotation of the pump and the magnitude of the pressure applied by the springs. The faster the pump is required to run, the greater must be the pressure exerted by the springs. For a determined type of spring there is therefore an upper speed of rotation at which the pump can still work. In addition, the previously mentioned loss of energy is the greater, the higher the speed at which the pump is to work. Yet another disadvantage consists in that when the pump has been out of use for some time the springs may be quite incapable of returning the piston. Moreover, the springs, which are situated in the delivery chamber, must be rustproof and resistant to chemicals. Furthermore, the springs also disturb the flow in the delivery chamber, give rise to large dimensions of the cylinder head, and so on.

Machines of the type first defined above are also known, in which the eccentric carries a bearing jewel in which at least one T-shaped slot is formed. A plate connected to the foot part of the piston is mounted in this slot. Considerable problems arise in the assembly of a machine of this kind. The pistons pass through the machine casing, so that they can be inserted into the casing only in the radial direction. The bearing jewel on the other hand can be inserted into the casing only in the axial direction. After these parts have been inserted into the machine casing, the piston must be connected to the bearing jewel. This connection is not easy to make. Similar problems obviously also arise in the servicing of such machines.

If a piston machine provided with the bearing jewel mentioned is to comprise more than two pistons arranged in star form around the shaft of the machine, it is practically impossible to produce such a machine with the bearing jewel.

The object underlying the present invention is that of indicating a piston machine in which the disadvantages mentioned do not occur.

In the piston machine of the kind first mentioned above, this object is achieved iin the manner defined in the characterizing part of claim 1.

A piston machine constructed in this manner may have three or more pistons arranged in star form, while both the assembly of a machine of this kind and its servicing can be effected in a very simple manner.

Figure 2:
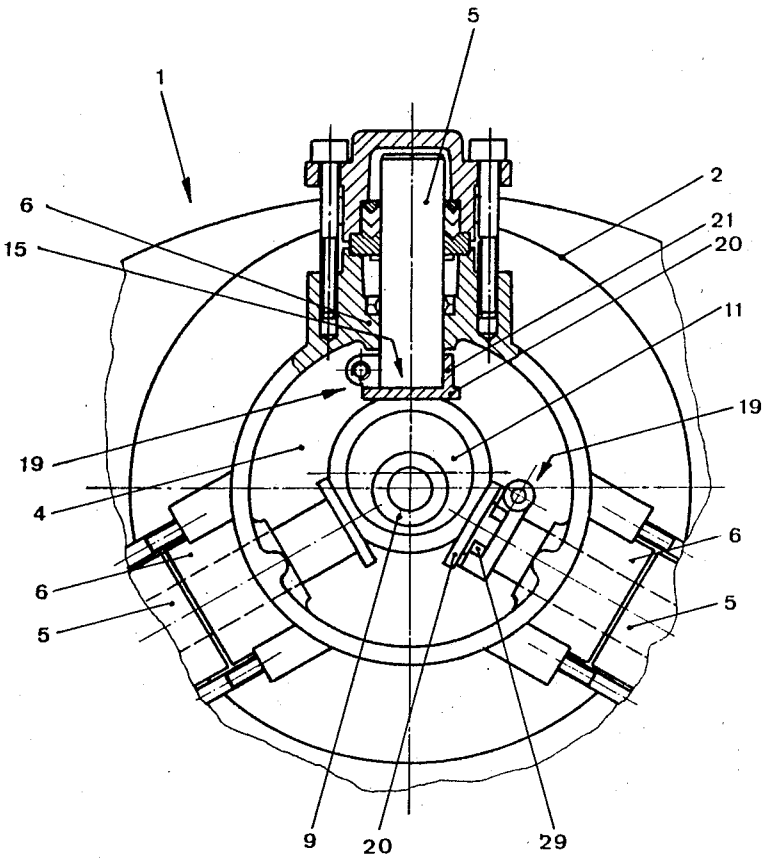
Figure 4:
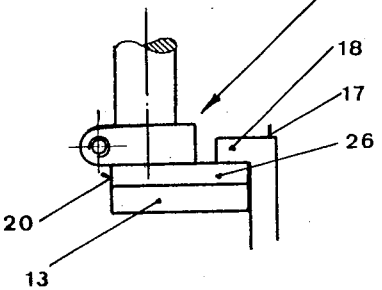
Figure 5:
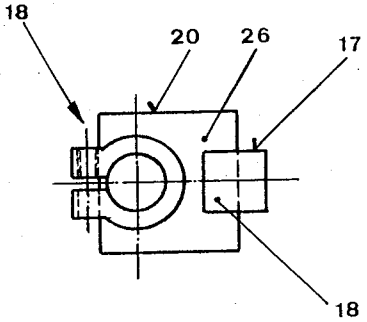
Figure 6:
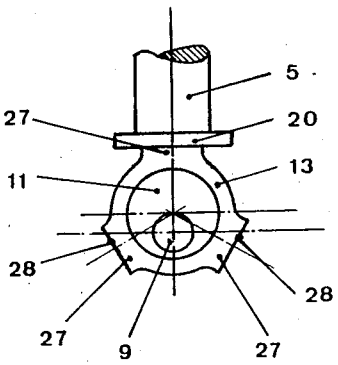
Figure 3:
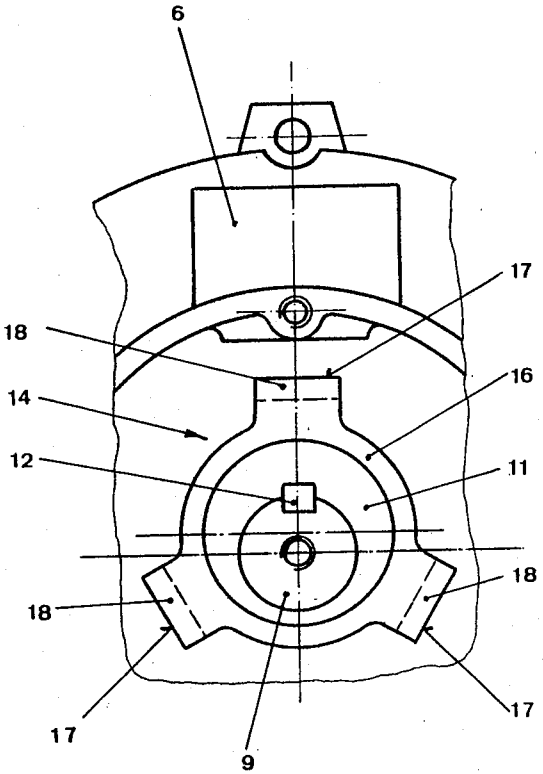
Figure 7:
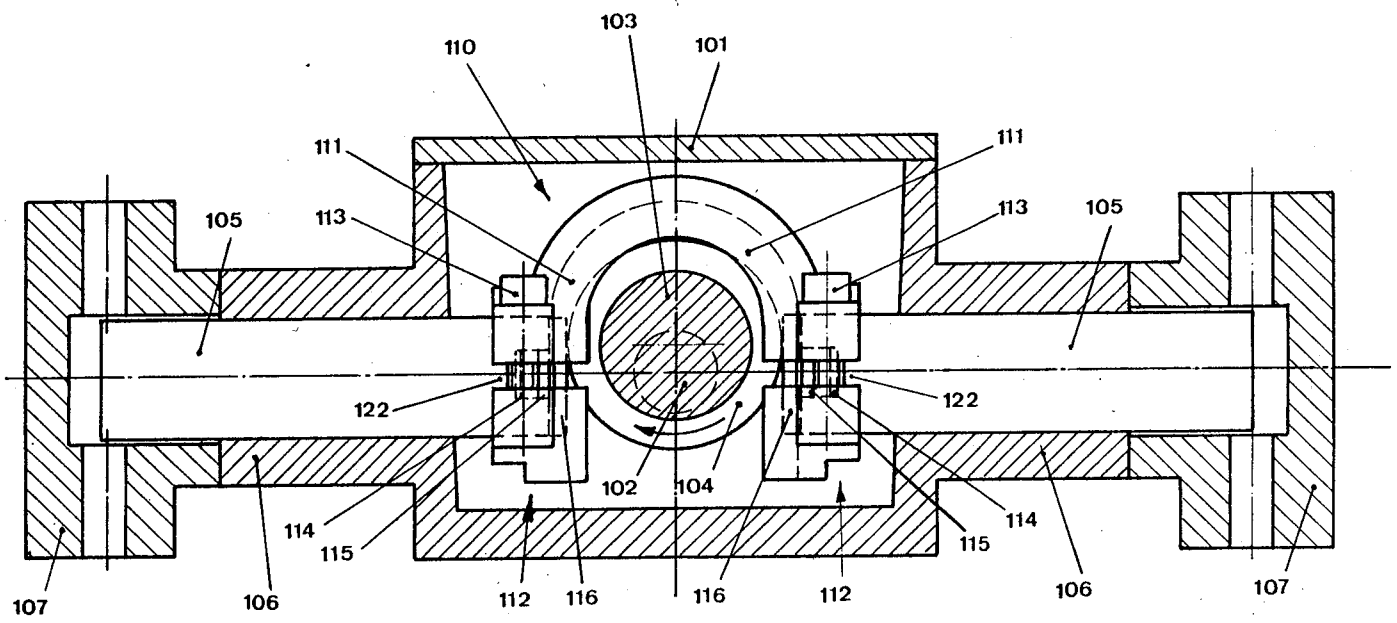
Figure 10:
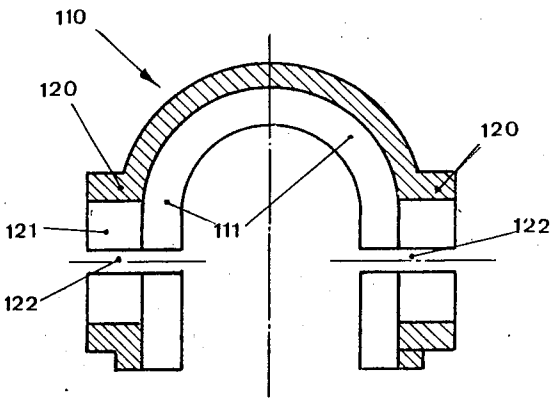
Figure 11:
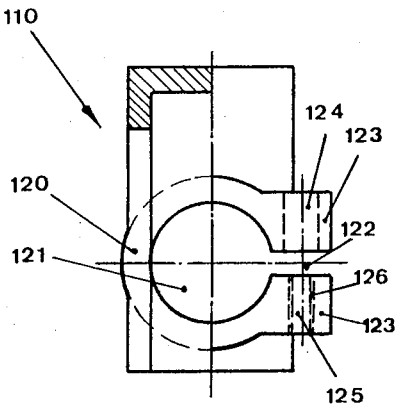
Figure 8:
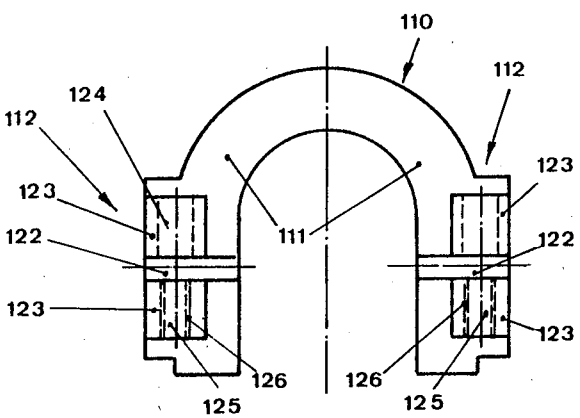
Figure 12:
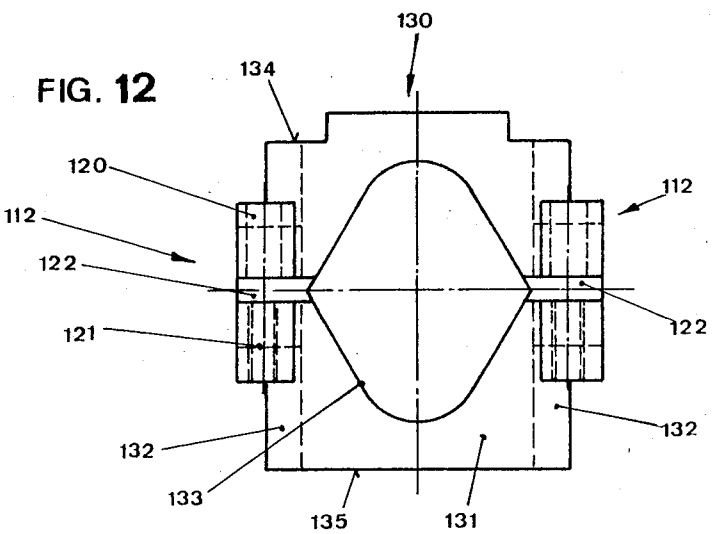
Figure 9:
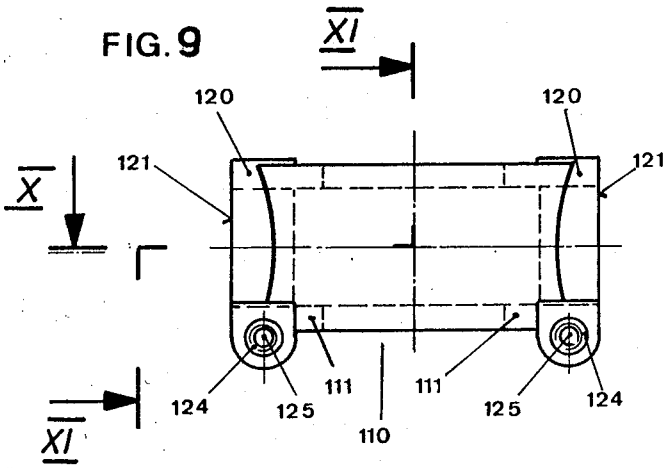
Figure 13:
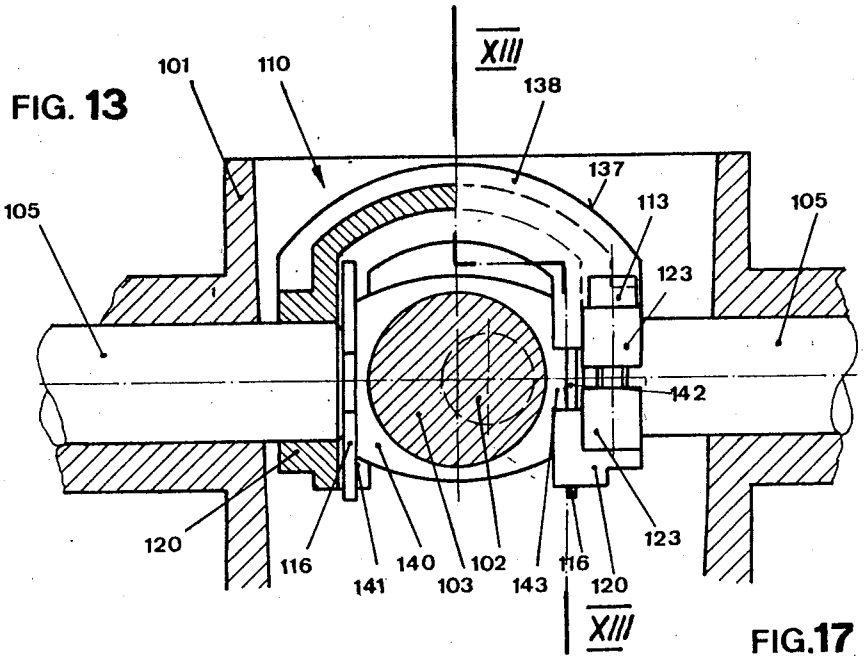
Figure 14:
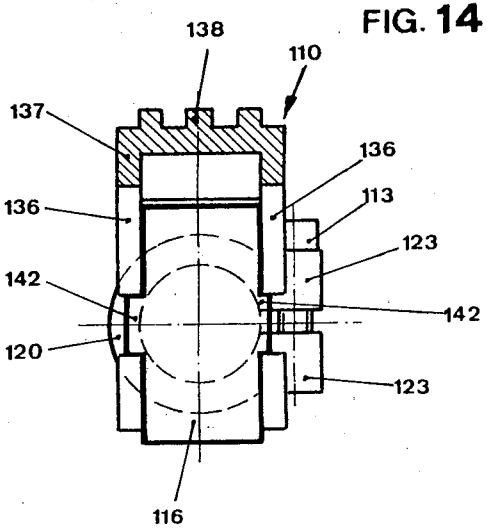
Figure 18:
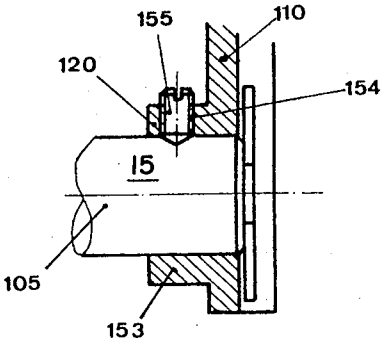
Figure 17:
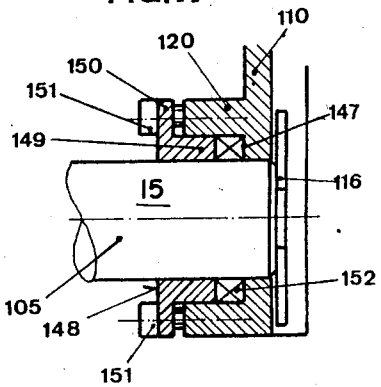
Figure 16:
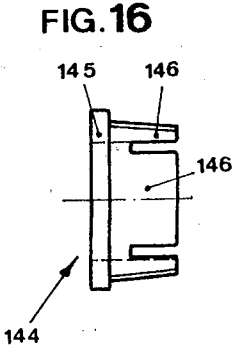
Figure 15:
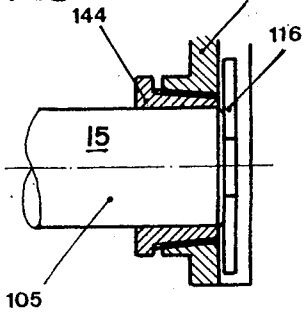

Examples of embodiment of the present invention are explained more fully below with reference to the accompanying drawings, in which:

FIG. 1 is an axial longitudinal section of the most important part of the machine in question, FIG. 2 is a front view of the part of the machine shown in FIG. 1, but omitting the machine cover, the support plate and the return device, FIG. 3 shows a part of the front view shown in FIG. 2, but including the return device, FIG. 4 is a side view of a subassembly from FIG. 1, FIG. 5 is a plan view of the same subassembly, FIG. 6 is a front view of a special form of construction of the sleeve of the machine in question, FIG. 7 is a longitudinal section of a piston machine in the form of a pump having two pistons, FIG. 8 is a front view of another form of construction of the return device, which will be referred to as a yoke, FIG. 9 is a plan view of the yoke shown in FIG. 8, FIG. 10 is a section through the yoke on the line X—X in FIG. 9, FIG. 11 is a section through the yoke on the line XI—XI of FIG. 9, FIG. 12 is an elevation of yet another form of construction of the yoke, FIG. 13 shows partly in longitudinal section a further development of the machine shown in FIG. 7, FIG. 14 is a section, taken on the line XIII—XIII, through a part of the machine shown in FIG. 13, FIG. 15 shows a form of construction of the device for fastening the piston in the yoke, FIG. 16 shows a collet nut in the device shown in FIG. 15, and FIGS. 17 and 18 show two further forms of construction of the device for fastening the piston to the yoke.

The machine shown in the drawings is a pump which is mounted on an electric motor, by which it is driven. The piston machine has a casing 2, which is fastened by means of bolts 3 to the casing of the electric motor 1.

In its central region the machine casing 2 has a cavity 4 in which the drive elements for the pistons 5 of the machine are accommodated. The pistons 5 accommodated in cylinders 6 are disposed in star form along the peripheral part of the cavity 4 in the machine casing 2. At the front this cavity is closed with the aid of a cover 7, which is removably fastened to the casing 2 with the aid of bolts 8.

That end 9 of the shaft of the electric motor 1 which drives the pump is mounted in a bearing 10, which at the same time also serves as the bearing for the pump. An eccentric 11 is mounted on the machine shaft 9 and coupled by means of a key 12 (FIG. 3) to the shaft 9. When it is desired to alter the stroke of the pistons 5, and thus also the delivery rate of the pump, the eccentric 11 can be replaced by an eccentric of a different shape. A sleeve 13, which is intended to act on the foot part of the respective piston 5, is mounted on the eccentric 11.

The piston machine is provided with a return device 14, which acts on the foot part 15 of the piston 5. This return device 14 comprises a body part 16 which is mounted on the eccentric 11. In addition, the return device 14 is provided with claws 17 which act on the foot part 15 of the pistons 5. In the example illustrated the body part 16 is annular. The return claws are in the form of projections from the body part 16, these projections being distributed on the peripheral part of the ring 16 and extending away from it in the radial direction. The ends of these projections are bent over towards one side, thus giving the claws 17 their shape. These bent-over portions 18 of the projections act on the foot part 15 of the piston 5. For this purpose the foot part 15 of the piston 5 may be provided with a corresponding recess (not shown).

In the example illustrated the foot part 15 of the piston 5 is provided with a shoe 19. This shoe 19 has a plate 20 which lies on the sleeve 13. In addition, the piston shoe 19 has a clamp 21 (see for example FIG. 2), which is integral with the foot plate 20 and in which the end part of the piston 5 is clamped fast. The piston 5 may be made of metal or of a ceramic material.

As has been mentioned, the foot plate 20 lies with its lower face on the sleeve 13. The return claw 17 on the other hand acts on the upper face of the foot plate 20. The movement of the piston 5 in the forward direction is thus brought about by the sleeve 13 resting on the eccentric 11, while the foot plate merely lies on the sleeve 13. The backwardly directed movement of the piston 5 on the other hand is brought about by the claw 17 of the return device 14, since the body part 16 of the return device 14 is mounted on the eccentric 11, so that this device makes the same movement as the sleeve 13 driving the pistons 5. As the bent-over portion 18 of the claw 17 acts on the top face of the foot plate 20, the latter remains in contact with the sleeve 13 even when making the return movement.

The advantage of this construction of the present machine should be obvious. For the assembly of the machine the pistons 5 are introduced from inside into the cylinders 6. The eccentric 11 with the sleeve 13 is then pushed onto the shaft end 9. The pistons are thereupon moved back until their foot parts 15 lie on the sleeve 13. It is now sufficient to push the return device 14 onto the eccentric 11 in such a manner that its claws 17 lie on the foot plates 20. In this way a piston machine can be assembled without problems even if it has three or more pistons arranged in star form. The pistons may be mounted directly in the material of the pump casing 2, which is normally of aluminium.

In order to ensure that the return claws 17 will not bend back during the operation of the machine, a support plate 22 lies on the return device 14 and is held in place by means of a screw 23 screwed into the shaft end 9. The support plate 22 is provided with a counterbalance weight 24 which eliminates all unbalance in this arrangement. It is obvious that support plates 22 provided with counterbalance weights of various sizes can be kept ready in order to be able to compensate for unbalance of different magnitudes.

Between the bearing 10 and the arrangement described a spacer disc 25 is disposed, on which the eccentric 11, the sleeve 13 and also the foot part 15 of the piston 5 are supported. The position of these elements of the machine and also the operational reliability of the machine are improved by the use of the spacer disc 25.

From FIGS. 4 and 5 it can be seen that the foot plate 20 has a part 26 which is extended in the direction of the return device 14 and on which the return claw 17 acts.

FIG. 6 illustrates a particularly advantageous form of construction of the sleeve 13. The outside of the sleeve 13 is provided with projections 27, in the apex region of which a slide surface 28 is provided. This slide surface 28 acts on the lower face of the foot part 15 of the pistons 5. In the example illustrated the slide surface 28 acts on the lower face of the foot plate 20. The dimension of the respective slide surface 28 in the peripheral direction of the sleeve 13 is advantageously smaller than the corresponding dimension of the lower face of the foot plate 20. The slide surface 28 and the lower face of the foot plate 20 form a sliding contact bearing. The sleeve 13, which is provided with these slide surfaces 28, and the eccentric 11, however, together also form a sliding contact bearing. The interior 4 of the casing 2 is normally about half filled with oil. During the operation of the pump the shaft is subjected to pulse loading by the pistons. The slide surfaces mentioned have very advantageous effects in these circumstances, since because of their size and of the film of oil lying between them they take this loading relatively smoothly, and therefore have a damping action. This also ensures better conditions in the event of emergency operation.

In order to keep the overall length of the pump in the axial direction as short as possible, the clamp 21 may be provided, in the region of the bent-over part 18 of the claw 17, with a cutout 29 (FIGS. 1 and 2), in which the bent-over part 18 of the return claw 17 engages.

In piston machines having two oppositely disposed pistons different problems arise. The return device, which is in the form of a yoke connecting these two pistons together, bridges over the eccentric 11. One end of the respective piston is mounted in the ends of this yoke. For this purpose the end of the respective piston is provided with a guide plate of metal. The yoke is likewise U-shaped in cross-section, while, in the end portions of the yoke, parts of the bottom of the yoke of U-shaped cross-section have been removed. The free-standing side walls of the yoke are each provided with a slot in which the guide plate of the respective piston is mounted.

The connection between the guide plate and the piston is made in this known machine by forming in the end of the piston a threaded blind hole. The guide plate is provided with a threaded pin screwed into the blind hole in the piston.

During the operation of a pump of this kind the eccentric lies on the guide plate of that piston which is on the way back. The rearward movement of this piston is brought about by the fact that the guide plate of this piston is coupled by the yoke to the guide plate of the opposite piston, which is now being moved forwards by the eccentric. The yoke thus pulls on the guide plate of the piston which is now moving backwards, this plate being connected to the piston by means of the pin fastened on this plate.

As can be seen, the point of connection of the piston of ceramic material to the metal pin is stressed during the operation of the pump by heavy forces, the direction of which moreover changes quickly. This may lead to the destruction of this connection and thus also to premature failure of the pump. Moreover, the yoke actually sits only loosely on the guide plates of the pistons, so that the clearances existing between the guide plates and the slots in the yoke may considerably increase in size in the course of time. This may lead to the destruction of the yoke and thus likewise to the failure of the pump. Furthermore, the assembly comprising the yoke and the two pistons has only slight stiffness, so that vibrations may occur in the pump.

Such problems do not occur if the piston machine is provided with the return device described below.

The piston machine illustrated in FIG. 7 is in the form of a piston pump. A drive shaft 102 is mounted for rotation in a casing 101. This shaft 102 is provided with an eccentric disc 103 on which an intermediate member 104 is mounted. This intermediate member is in the form of a slide ring.

The pump has two horizontally disposed pistons 105 which lie diametrically opposite one another and which are of ceramic material. These pistons 105 are in the form of a cylindrical rod, and they are mounted for longitudinal movement in respective cylinders 106. A cylinder head 107, in which valves (not shown) are accommodated, terminates the respective cylinder. Each cylinder head 107 is also provided with connections (not shown) for a suction line and for a delivery line (not shown).

The casing 101 of the pump contains a yoke 110, which is U-shaped and serves as return device. The cross-section of the yoke 110 is however also U-shaped, so that parts of the slide ring 104 can be situated in the yoke. The end portions of the arms 111 of the U-shaped yoke 110 are provided with clamp devices 112, in which the pistons 105 are fastened at one end. Rigid fastening of the pistons 105 in the respective clamp device 112 is achieved with the aid of bolts 113.

Through the arrangement of the previously mentioned parts of the slide ring 104 in the yoke 110, the slide ring, which otherwise is slidable on the eccentric 103, is given lateral guidance. Conversely, this reciprocal arrangement of the yoke 110 and slide ring 104 prevents the yoke 110, which otherwise is only joined to the pistons 105, from tipping.

The end of the respective piston 105 facing the eccentric 108 is provided with a blind hole 114. This blind hole 114 receives a pin 115, which is fastened to a metal plate 116. One side of this plate 116 lies on the end face of the piston. The other side of the plate 116 can come into contact, during the operation of the pump, with the slide ring 104 which is situated on the eccentric 103.

If the piston 105 must have a solid profile, the plate 116 can form the bottom of a sleeve. This cap-like construction is disposed on the end of the piston 105 which faces the eccentric 103.

The piston 105 may however also be in the form of a sleeve. In such a case the mouth of a sleeve of this kind is closed by the plate 116, while the pin 115 is situated in the interior of the sleeve-type piston in order to guide the plate.

When the shaft 102 is driven, for example in the direction of the arrow shown in FIG. 7, the slide ring 104 on the eccentric disk 103 first pushes the righthand piston 105 to the right, applying pressure to the plate 116. Since the yoke 110 is fastened on the righthand piston 105 with the aid of the righthand clamp device 112, the yoke 110 also moves to the right. At the other end of the yoke 110 the lefthand piston 105 is fastened with the aid of the lefthand clamp device 112. In consequence, the lefthand piston 105 now also moves to the right. After eccentric 103 has reached its outermost righthand position, it begins to apply pressure to the plate 116 of the lefthand piston 105. This has the effect that the rigid structure consisting of the two pistons 105 and the yoke 110 begins to move to the left. After the eccentric 103 has reached its outermost lefthand position, it begins once more to apply pressure to the plate 116 of the righthand piston 105. The rigid structure referred to above now moves again to the right, and so on. In cooperation with the valves (not shown) in the cylinder heads 107, a pumping action is achieved with a piston machine of this kind.

The yoke 110 shown in FIG. 8 corresponds to the yoke shown in FIG. 7, while further details of this yoke can be seen in FIGS. 9 to 11. As already stated, this yoke 110 is U-shaped, its arms 111 each being provided with a clamp device 112 for the pistons 105. As likewise already stated, the cross-section of the yoke is substantially U-shaped, as can be seen in FIGS. 9 to 11. The clamp device 112 has a substantially annular portion 120, while one end of the respective piston 105 is situated in the opening 121 of this annular portion 120. This annular portion 120 is interrupted by a slot 122. The ring 120 interrupted in this manner is thus resilient. The yoke shown in the drawings is in the form of a casting, although it could for example also be made of sheet metal.

On both sides of the slot 122 the ends of the annular portion 120 have accumulations of material 123, which are provided with bores 124 and 125. The bottom bore 125 is provided with a screwthread 126 with which the screwthread of the bolt 113 (FIG. 7) is in engagement. Through the tightening of the bolt 113 the slot 122 is reduced in size, and the piston 105 is thereby clamped fast in the annular portion 120 and thus also in the yoke 110.

In piston machines of greater power the U-shaped yoke of the kind described would nevertheless have a certain resilience, so that the assembly comprising the yoke and the pistons would not be as rigid as is required for the machine to operate without vibration. In order to be able to ensure that the assembly in question will be free from vibration even in machines of greater power, the yoke or the connector may be of the construction shown in FIG. 12.

The yoke 130 in FIG. 12 has two end walls 131 which lie parallel to one another, and of which only the front end wall can be seen in FIG. 12. The end walls 131 are joined together with the aid of the side walls 132,which are shorter than the end walls 131. The end walls 131 each have an opening 133, through which the shaft 102 carrying the eccentric 103 can pass. The side walls 132 of this yoke are provided with the previously mentioned clamp devices 112 for the pistons 105. The opening 121 in the annular portion 120 of the clamp device 112 is extended into the side wall 132 of the yoke 130. The annular portion 120 also has the slot 122 in this case, the bolt (not shown here) previously mentioned passing through this slot. The fastening of the respective piston in this yoke is thus effected in the manner previously described.

Since the pistons 105 are connected together with the aid of a top portion 134 and a bottom portion 135 of the yoke 130, this yoke has extraordinarily great stiffness, and the assembly comprising the pistons and the yoke is very rigid.

The yoke 130 may however also be constructed in such a manner that the upper portion 134 and the lower portion 135 form two parts which in order to be able to form the yoke are bolted together with the aid of four bolts 113. Each of the yoke halves 134, 135 then has only a part of the annular portion of the clamp device 112, while however at the two ends of the respective part of the annular portion there is in each case an accumulation of material (not shown) through which the bolts 113 are passed, or into which these bolts are screwed.

In the case of the present machine the pistons may also be disposed in rows side by side. Juxtaposed pistons can be driven by a plurality of eccentrics mounted on a common crankshaft 102. The yoke 130 shown in FIG. 12 however also makes it possible for its side walls 132 to be provided with a plurality of clamp devices 112, so that the pistons are then for example situated one above the other. For the purpose of driving a plurality of pistons a single eccentric and a single yoke are sufficient in such a case.

FIG. 13 illustrates a further development of the machine shown in FIG. 7. Although this machine has once again a U-shaped yoke 110, nevertheless the portion 137 thereof which connects the arms 136 of this yoke is provided with reinforcing ribs 138. These ribs 138 increase the stiffness of the yoke 110. The construction and arrangement of the reinforcing ribs 138 can be clearly seen in FIG. 14. In the example illustrated the reinforcing ribs 138 are situated on the outside of the connecting part 137. Such ribs can if necessary also be situated on the inside of the connecting part 137. One of the consequences of the use of such ribs is that the flexural stressing of the pistons 105 in the region of the clamp device 112 is reduced. In addition, this arrangement contributes towards quieter running of the machine, particularly when the machine runs at a high speed of rotation.

The intermediate member which is situated between the eccentric 103 and the piston 105 is in the form of a sliding member in this form of construction of the machine. In this case the respective plane surface 141 of the sliding member 140 faces the end of the piston 105 on the eccentric side. The use of the sliding member 140 provides the advantage that the area of contact between the sliding member 140 and the piston 105, or the plate 116 disposed in front of the piston 105, will be large, while a film of lubricating agent can be formed between them. The moment transmitted from the eccentric to the piston can consequently be greater without the material of these components being overstressed.

In this form of construction of the present machine the plate 116 is also differently constructed. This plate 116 has projections 142 resting in slots 143. These slots 143 are formed in the inside of the arms 136 of the yoke 110. The plate 116 is plane on both sides, and it is held in position with the aid of its projections 142. One plane surface of this plate 116 lies on the piston 105, while the other plane surface is under the action of the sliding member 140. As can be seen in FIG. 14, the plate 116 has a quadrangular plan shape.

FIG. 15 shows another possible way of fastening the piston 105 in the yoke. The inside wall of the annular portion 120 is provided with a conical screwthread, into which a collet nut 144 is screwed. The collet nut 144 is shown separately in FIG. 16. It has a flat portion 145 whose periphery is hexagonal. A wrench can be applied to this portion and thus the nut 144 can be screwed into the yoke. Tongues 146 extend from this flat portion 145 and are provided on the outside with a corresponding screwthread. The tightening of the nut 144 reduces the distance between the tongues 146 and the piston 105 is thus held in place. As can be seen in FIG. 17, the inside of the annular portion 120 can be provided with a bearing surface 147. This additional form of construction of the clamp device is provided with a pressure member 148 which contains a tubular portion 149. The flange 150 of this member is provided with openings through which bolts 151 pass, these bolts being screwed into the yoke 110. Between the end face of the tubular portion 149 and the bearing surface 147 is situated an annular clamp member 152. Through the tightening of the bolts 151 the clamp member is compressed, so that the diameter of the opening in the clamp member 152 is reduced in size and thus the piston is held in the clamp device.

FIG. 18 shows yet another possible form of construction of the clamp device 112, which can be used in particular when the piston 105 is of steel. The annular portion 120 of the yoke 110 is in the form of a tube, the wall of this tube being provided with an opening 154 having a screwthread. A clamp screw 155, whose tip penetrates into the material of the piston 105, is screwed into this opening.

The forces returning the piston 105 act on the surface of the piston in a machine constructed in this manner. The surface on which these forces now act is however larger than the surface which was available in the region of the screw connection between the threaded pin and the piston hitherto. In addition, the piston 105 is now held in a clamp 112, whereas previously only a screw connection was used between the piston and the pin. Finally, the assembly consisting of the yoke 110 and at least one piston 105 has substantially greater rigidity, so that vibrations can scarcely occur.

In the present machine the pin 115 integral with the plate 116 can also be screwed into the piston 105, but it is advantageous for this pin 115 merely to be inserted into the piston 105, because this connection is of course subjected only to compressive stress since the piston 105 is returned with the aid of the yoke 110 acting on the piston body.

Pumps having two or more pistons are described above. If a pump or other type of piston machine is to have only a single piston, one of the pistons may be replaced by a so-called dummy piston (not shown) fastened in the yoke. This dummy piston may also be in the form of only a short rod clamped in the other clamp device. The end of this rod facing the eccentric is provided with a plate which has already been described in connection with the machine shown in FIG. 1.

I claim:

1. A piston machine having at least two pistons and comprising: shaft means for driving the machine; an eccentric mounted on said shaft means; a plurality of pistons within respective cylinders radially disposed about said eccentric and thus having one end closer to the shaft means, each piston having a foot end closer to the shaft means; sleeve means circumferentially disposed around the eccentric for thrusting each piston away from said shaft means; return means circumferentially disposed around the eccentric for pulling each piston toward the shaft means and wherein said sleeve means and said return means are separable; a casing having a cavity therein; a cover means for covering the cavity; bearing means for supporting the shaft means in the casing, the bearing means being disposed in a portion of the casing opposite said cover means and wherein said return means is between the pistons and the cover means; spacer disk means for supporting the eccentric, the sleeve means, and the foot ends, said spacer disk means being disposed between the bearing means and the pistons.

2. A piston machine having at least two pistons and comprising: shaft means for driving the machine; an eccentric mounted on said shaft means; a plurality of pistons within respective cylinders radially disposed about said eccentric and thus having one end closer to the shaft means, each piston having a foot end closer to the shaft means, wherein the foot end of each of said pistons has a shoe comprising a plate including a laterally extended portion and a clamp integral with the plate in which the foot end of the piston is clamped; sleeve means circumferentially disposed around the eccentric for thrusting each piston away from said shaft means; return means circumferentially disposed around the eccentric for pulling each piston toward the shaft means, wherein said sleeve means and said return means are separable; a casing having a cavity therein; a cover means for covering the cavity; bearing means for supporting the shaft means in the casing, the bearing means being disposed in a portion of the casing opposite said cover means, and wherein said return means is between the pistons and the cover means.

3. A piston machine as in claim 2 wherein the clamp has a cut-out for engaging the claws.

4. A piston machine having at least two pistons and comprising: shaft means for driving the machine; an eccentric mounted on said shaft means; a plurality of pistons mounted within respective cylinders radially disposed about said eccentric and thus having one end closer to the shaft means, each piston having a foot end closer to the shaft means; sleeve means circumferentially disposed around the eccentric for thrusting each piston away from said shaft means; return means circumferentially disposed around the eccentric for pulling each piston toward the shaft means, said return means comprising an annular member and claws projecting therefrom, each of said claws being positioned to engage the foot end of a different piston and wherein said sleeve means and said return means are separable; support plate means for supporting and reinforcing said claws; and counterweight means for balancing said eccentric and said shaft means during rotation thereof, wherein said counterweight means is disposed on said support plate means.

5. A piston machine having at least two pistons and comprising: shaft means for driving the machine; an eccentric mounted on said shaft means; a plurality of pistons mounted within respective cylinders radially disposed about said eccentric and thus having one end closer to the shaft means, each piston having a foot end closer to the shaft means; sleeve means circumferentially disposed around the eccentric for thrusting each piston away from the shaft means; return means circumferentially disposed around the eccentric for pulling each piston toward the shaft means, wherein said sleeve means and said return means are separable; a casing having a cavity therein; a cover means for covering the cavity; bearing means for supporting the shaft means in the casing, the bearing being disposed in a portion of the casing opposite said cover means; and wherein said return means is between the pistons and the cover means.

* * * * *